US006983745B2

(12) United States Patent
Tang et al.

(10) Patent No.: US 6,983,745 B2
(45) Date of Patent: Jan. 10, 2006

(54) ISOLATION SUIT WITH TWO-WAY AIR SUPPLY/DISINFECTION PUMP

(75) Inventors: Wai Choi Tang, Hong Kong (CN); Wilson Sai Mo Wong, Hong Kong (CN)

(73) Assignee: Winsource Industries Limited, Kowloon (CN)

( * ) Notice: Subject to any disclaimer, the term of this patent is extended or adjusted under 35 U.S.C. 154(b) by 0 days.

(21) Appl. No.: 10/910,876

(22) Filed: Aug. 4, 2004

(65) Prior Publication Data

US 2005/0045178 A1 Mar. 3, 2005

(30) Foreign Application Priority Data

Aug. 26, 2003 (HK) ..... 03106107 A

(51) Int. Cl.
*A62B 7/10* (2006.01)

(52) U.S. Cl. ..... 128/201.25; 128/201.29; 128/205.22

(58) Field of Classification Search ..... 128/201.25, 128/201.29, 205.18, 205.22
See application file for complete search history.

(56) References Cited

U.S. PATENT DOCUMENTS 1,695,107 A * 12/1928 Kahl ..... 607/113
3,736,927 A * 6/1973 Misaqi ..... 128/201.25
3,747,599 A * 7/1973 Malmin ..... 128/201.12
4,019,508 A * 4/1977 Der Estephanian et al. ..... 128/202.19
4,055,173 A * 10/1977 Knab ..... 128/847
4,127,122 A * 11/1978 Kienhofer et al. ..... 128/201.25
4,590,951 A * 5/1986 O'Connor ..... 128/204.23
4,901,716 A * 2/1990 Stackhouse et al. ... 128/201.25
5,042,474 A * 8/1991 Williamson ..... 128/206.12
5,046,492 A * 9/1991 Stackhouse et al. ... 128/200.27
5,394,870 A * 3/1995 Johansson ..... 128/205.22
5,577,496 A * 11/1996 Blackwood et al. ... 128/201.25
5,906,203 A * 5/1999 Klockseth et al. ..... 128/205.24
5,950,621 A * 9/1999 Klockseth et al. ..... 128/204.26
6,302,105 B1 * 10/2001 Wickham et al. ..... 128/204.18
6,443,147 B1 * 9/2002 Matter ..... 128/200.26
6,470,888 B1 * 10/2002 Matter ..... 128/207.14
6,796,304 B2 * 9/2004 Odell et al. ..... 128/201.29

FOREIGN PATENT DOCUMENTS

CH 671340 A5 8/1989
EP 464234 B1 12/1994
GB 2248173 A 4/1992

* cited by examiner

*Primary Examiner*—Aaron J. Lewis
(74) *Attorney, Agent, or Firm*—Alix, Yale & Ristas, LLP

(57) ABSTRACT

An isolation suit has a two-way air supply/disinfection pump attached to it. The pump has a pair of through-passages each communicating with an interior of the suit by respective airlines. There is a fan in each through-passage, one of which delivers air to the suit and the other of which extracts air from the suit. The isolation suit has an ultraviolet light in each through-passage for disinfecting air that is drawn through by the fans.

4 Claims, 2 Drawing Sheets

ISOLATION SUIT WITH TWO-WAY AIR SUPPLY/DISINFECTION PUMP

BACKGROUND OF THE INVENTION

The present invention relates to isolation suits. More particularly, although not exclusively, the invention relates to a protective isolation suit as might be worn by hospital staff or hospital patients especially in infectious disease wards.

Infectious airborne diseases are readily transmitted from person-to-person in environments such as hospital infectious disease wards. Protective suits are worn in such environments as a form of physical barrier.

It would be impractical for an uninfected person wearing a protective suit to carry an oxygen tank for example. Such tanks are heavy and have a limited oxygen supply and are expensive and time-consuming to replenish.

Furthermore, in the instance where an infected person is wearing a protective gown to protect those in the vicinity, some means of filtering his or her exhaled air is needed.

In early stages of infection, an infected person might not know that he or she is infected and therefore a two-way air filtering system is desirable.

OBJECT OF THE INVENTION

It is an object of the present invention to overcome or substantially ameliorate at least one of the above disadvantages and/or more generally to provide a protective gown having a two-way filtering pump for exhaled air and air to be inhaled by its wearer.

DISCLOSURE OF THE INVENTION

There is disclosed herein an isolation suit having a two-way air supply/disinfection pump attached thereto, the pump comprising a pair of through-passages each communicating with an interior of the suit by respective airlines, and a fan in each through-passage, one of which delivers air to the suit and the other of which extracts air from the suit.

Preferably, the pump further comprising a disinfection means in each through-passage for disinfecting air that is drawn therethrough by the fans.

Preferably, the disinfection means each comprise an ultraviolet light.

Preferably, the fans draw air through each through-passage in mutually opposite directions.

BRIEF DESCRIPTION OF THE DRAWINGS

A preferred form of the present invention will now be described by way of example with reference to the accompanying drawings, wherein.

DESCRIPTION OF THE PREFERRED EMBODIMENT

Figure 1:
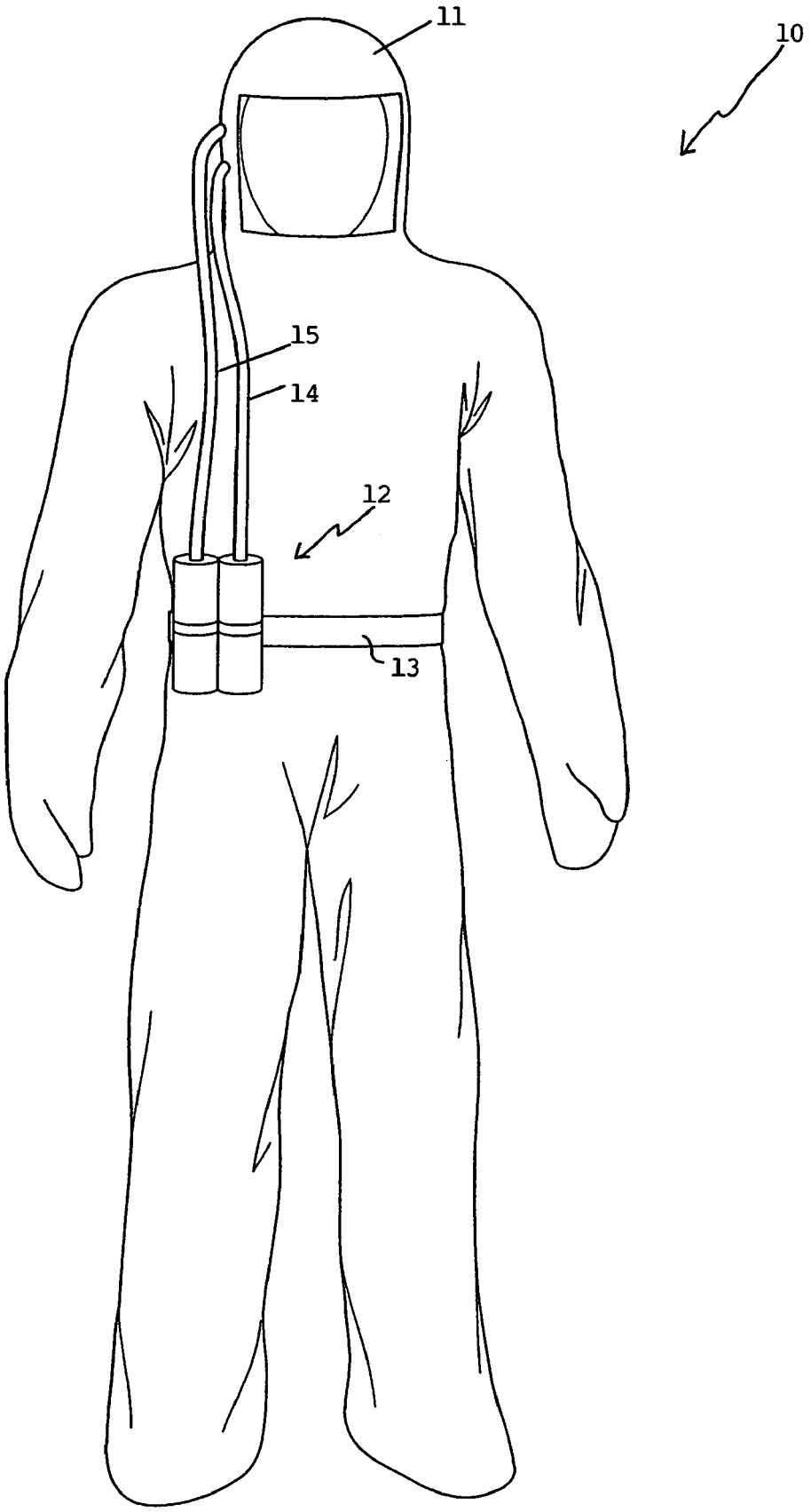
FIG. 1 is a schematic illustration of a protective gown having a two-way filter pump attached thereto.
Figure 2:
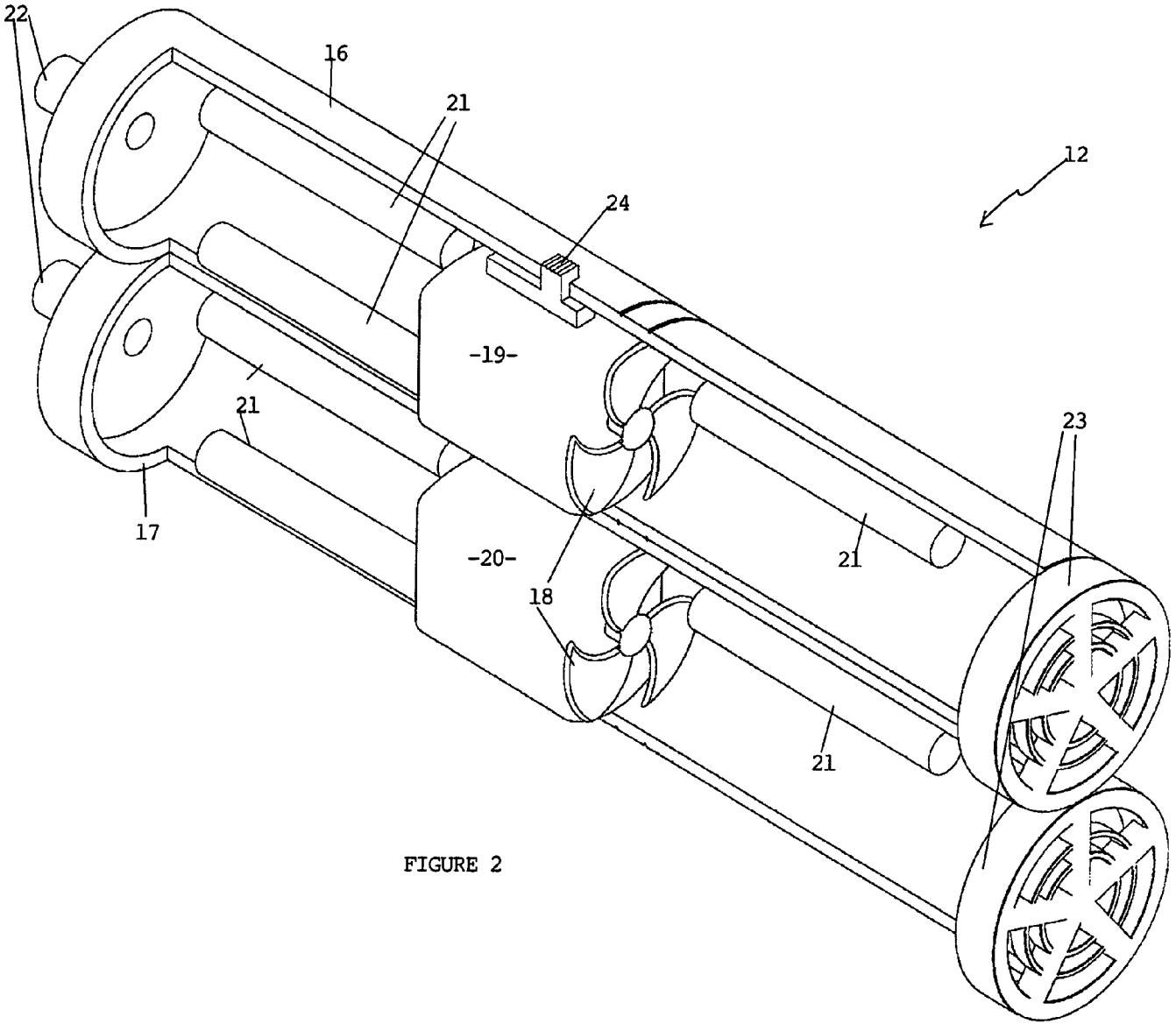
FIG. 2 is a schematic perspective cut-away diagram of the two-way filter pump.

In the accompanying drawings there is depicted schematically a protective suit 10 having a hood 11. Attached to a belt 13 about the suit 10 is a two-way filter pump 12 having a pair of flexible airlines 14 and 15 extending therefrom to the hood 11. The flexible airlines might be attached to short pipe extensions formed integrally with or attached to the hood 11.

The filter pump 12 comprises a pair of cylinders 16 and 17 each having an electrically powered fan 18 therein. Power to each fan might be from rechargeable or disposable batteries located within respective compartments 19 and 20. Each fan is driven by an electric motor (not shown, but located within the respective compartments 19 and 20 or nearby those compartments). The fans rotate in opposite directions to one another.

One or more ultraviolet fluorescent tubes 21 are located within each cylinder.

At one end of each cylinder there is provided a airline attachment port 22 to which the flexible airlines 14 and 15 are connected. At the other end of each cylinder there is a vent or grate 23. Immediately behind each vent or great there might be provided a physical particle filter (not shown).

There is a switch 24 connected electrically with the batteries so as to activate the fans 18 and the ultraviolet fluorescent tubes 21.

In use, the switch 24 is turned on so as to activate the ultraviolet tubes 21 and the fan motors. Air that is drawn through each cylinder is disinfected by ultraviolet light emanating from the fluorescent tubes so that air passing both to and from the isolation suit 10 via the tubes 14 and 15 is disinfected. The interior of each cylinder might be reflective to increase efficiency. Furthermore there might be just a single motor driving both fans in opposite directions by a twisted belt for example extending about drive pulleys.

What is claimed is:

1. An isolation suit having a two-way air supply/disinfection pump attached thereto, the pump comprising a pair of through-passage cylinders each communicating with an interior of the suit by respective airlines, and a fan in each cylinder, one of which delivers air to the suit and the other of which extracts air from the suit, an ultraviolet fluorescent tube in each cylinder for disinfecting air that is drawn therethrough by the fans.

2. The isolation suit of claim 1 wherein the fans draw air through each through-passage cylinder in mutually opposite directions.

3. The isolation suit of claim 1 wherein the cylinders each define a longitudinal axis and the tubes are parallel to each said longitudinal axis.

4. The isolation suit of claim 1 wherein there are a plurality of ultraviolet fluorescent tubes in each said cylinder.

* * * * *